US007303193B2

(12) United States Patent
Miletich

(10) Patent No.: US 7,303,193 B2
(45) Date of Patent: Dec. 4, 2007

(54) BALANCING TUBE GAME AND APPARATUS

(76) Inventor: Jack W. Miletich, P.O. Box 1108, Ottumwa, IA (US) 52501

( * ) Notice: Subject to any disclaimer, the term of this patent is extended or adjusted under 35 U.S.C. 154(b) by 0 days.

(21) Appl. No.: 11/549,929

(22) Filed: Oct. 16, 2006

(65) Prior Publication Data

US 2007/0090603 A1 Apr. 26, 2007

Related U.S. Application Data

(60) Provisional application No. 60/596,710, filed on Oct. 14, 2005.

(51) Int. Cl.
*A63F 9/26* (2006.01)
*A63F 9/24* (2006.01)

(52) U.S. Cl. ..... 273/449; 273/460

(58) Field of Classification Search ..... 273/440, 273/449, 454, 455, 459, 460; 434/258
See application file for complete search history.

(56) References Cited

U.S. PATENT DOCUMENTS 3,411,777 A * 11/1968 Durand ..... 273/449
3,784,196 A 1/1974 Berlin
3,960,376 A 6/1976 Berlin
4,076,238 A * 2/1978 Dively ..... 273/449
4,892,307 A * 1/1990 Lehberger ..... 273/449
D485,869 S * 1/2004 Miletich ..... D21/399
2007/0090603 A1* 4/2007 Miletich ..... 273/449

* cited by examiner

*Primary Examiner*—Raleigh W. Chiu
(74) *Attorney, Agent, or Firm*—Howard M. Cohn

(57) ABSTRACT

An amusement device in the form of a balancing tube game is described. In typical use, the balancing tube is balanced in a vertical orientation on a user's palm, finger, head, elbow, foot or wherever they wish to balance it. The balancing tube game comprises an elongated cylindrical tube with built-in tilt-sensing electronics and audible, visual and tactile feedback. The tilt-sensing electronics are adapted to sense whenever the tube tilts off-vertical by more than a predetermined critical angle. The built-in electronics comprise a microprocessor, tilt sensor, lights, a noise-generating element, such as a speaker, and a vibrator. Optionally, a motion sensor can be added so that game can confirm that it is being manipulated (rather than simply fixed in a vertical orientation). While playing the game, the user progresses through a predetermined series of game levels, each level being characterized by a specific set of lights, sounds and/or vibrations emanating from the game. Once the game is started, a first sequence of lights, sounds and/or vibrations begins to indicate that the game is in the first level. If the balancing tube remains balanced, the game progresses to a second level, indicated by a new set of lights sounds and/or vibrations. As long as the tube remains balanced, the game continues advancing through various game levels until a final level is reached. Throughout the levels, various lights illuminate on the balancing tube, sounds are emitted, and the vibrator may activate or deactivate.

17 Claims, 5 Drawing Sheets

BALANCING TUBE GAME AND APPARATUS

CROSS-REFERENCE TO RELATED APPLICATIONS

This application claims the benefit of U.S. Provisional Patent Application No. 60/596,710 filed on Oct. 14, 2005 which is incorporated herein by reference.

TECHNICAL FIELD

The present invention relates to electronic games of skill, and more particularly to balancing games wherein a player attempts to balance a tall, slender object.

BACKGROUND ART

U.S. Pat. No. 3,960,376 issued on Jun. 1, 1976 to Evan H. Berlin (hereinafter "BERLIN") describes an elongated, substantially cylindrical toy design to simulate the appearance of the head end portion of a cobra preparing to strike. The shaped of the toy includes a simulation of a cobra's head, flattened "hood" and a portion of the body extending downward away from the head such that the head is at one end of the toy and a "stub" end of the body is at the other end of the toy. The toy is intended to be balanced with the stub end of the body in the open palm of a player's hand such that the head end of the toy is maintained in an upright posture. The player moves his hand under the toy to maintain its balance. Electrical circuits, including lamps selectively located in the toy and an electrical energy source are disposed within the toy. As long as the toy remains balanced, the lamps are illuminated in a predetermined, timed sequence by the electrical circuit. Tilt detectors (e.g., mercury switches) within the toy detect when the toy has fallen beyond a predetermined critical angle). If the toy tilts beyond the critical angle during play, the electrical circuit is reset (also resetting the sequence of lights) thereby ending play. The principal object of play is to balance the toy for a period of time sufficient to allow the predetermined light sequence to complete.

SUMMARY OF INVENTION

It is an object of the present invention to provide a balancing skill game with visual, audible and tactile feedback.

It is a further object of the present invention to provide a balancing skill game having multiple game levels.

It is a further object of the present invention to provide a balancing skill game that is simple to use.

It is a further object of the present invention to provide a balancing skill game that develops motor skills and coordination.

The present invention is an amusement device in the form of an elongated, cylindrical balancing tube game. In typical use, the balancing tube is balanced in a vertical orientation on a user's palm, finger, head, elbow, foot or wherever they wish to balance it. The balancing tube game is essentially a cylindrical tube with built-in level sensing electronics with audible, visual and tactile feedback. The electronics are adapted to sense whenever the tube tilts off-vertical by more than a predetermined critical angle, e.g., 45 degrees. The built-in electronics comprise a microprocessor (microcontroller), tilt sensor, lights, a noise-generating element, such as a speaker, and a vibrator. Optionally, a motion sensor can be added so that game can confirm that it is being manipulated (rather than simply fixed in a vertical orientation). While playing the game, the user progresses through a predetermined series of game levels, each level being characterized by a specific set of lights, sounds and/or vibrations emanating from the game. Once the game is started, a first sequence of lights, sounds and/or vibrations begins to indicate that the game is in the first level. If the balancing tube remains balanced, the game progresses to a second level, indicated by a new set of lights sounds and/or vibrations. As long as the tube remains balanced, the game continues advancing through various game levels until a final level is reached. Throughout the levels, various lights illuminate on the balancing tube, sounds are emitted, and the vibrator may activate or deactivate.

The ornamental design for a preferred embodiment of the balancing tube is the subject of design patent D485,869.

According to the invention, the inventive balancing tube game apparatus comprises an elongated tube enclosing an electronic circuit. The electronic circuit comprises a microcontroller, a tilt sensor connected to an input of the microcontroller, a speaker controllable by said microcontroller to produce audible sounds, a vibrator controllable by said microcontroller to produce tactile vibrations through the body of the game apparatus, and a light bank controllable by said microcontroller to produce a plurality of light patterns.

According to an aspect of the invention, the light bank further comprises a plurality of LEDs, controllable by the microcontroller. The LEDs are disposed within the tube and when illuminated, are visible through the tube. Preferably, the tube is formed of a translucent material.

According to another aspect of the invention, the vibrator can be a motor-driven eccentric weight controlled by the microcontroller, similar to those used to produce vibrations in cell phones.

According to another aspect of the invention, the microcontroller monitors the tilt sensor during a plurality of predetermined time intervals, providing feedback to a user via the light bank, speaker and vibrator.

According to another aspect of the invention, multiple game levels of predetermined duration are indicated by associated patterns of lights, sound and vibration from the light bank, speaker and vibrator, respectively.

According to another aspect of the invention, upon successful completion of a final game level, the microcontroller produces a game completion sequence comprising a specific sequence of lights, sounds and vibration.

According to another aspect of the invention, upon detection of a tilt condition where the elongated tube falls beyond a predetermined critical angle off-vertical, the microcontroller produces a tilt sequence comprising a specific sequence of lights, sounds and vibration.

According to another aspect of the invention, the electronic circuit can further include a motion sensor connected to an input of the microcontroller. If during any game level it is determined that no motion has been sensed for a predetermined period of time, game play is discontinued.

Other aspects of the invention are directed to a method of game play. According to one such aspect, a method of playing a balancing tube game comprises providing an elongated, cylindrical balancing tube game apparatus. The game apparatus is adapted to monitor a tilt sensor and to provide visual, audible and tactile indications to a user. The user balances the game apparatus on a body part for a predetermined amount of time on a plurality of game levels. If the user successfully maintains the game apparatus at an angle less than a predetermined critical angle off vertical during a game level, the user receives a game level indication. If the user fails to maintain the game apparatus within the predetermined critical angle off-vertical, the user receives an unsuccessful completion indication and game play is discontinued. If the user completes a final game level successfully, the user receives a successful game completion indication.

BRIEF DESCRIPTION OF THE DRAWINGS

These and further features of the present invention will be apparent with reference to the following description and drawing, wherein.

DETAILED DESCRIPTION OF PREFERRED EMBODIMENTS

The present invention is an amusement device in the form of a balancing tube game. In typical use, the balancing tube is placed on a user's palm, finger, head, or wherever they wish to balance it. The balancing tube contains a microprocessor (microcontroller), lights, a noise-generating element, such as a speaker, and a vibrator. While playing the game, the user progresses through a predetermined series of game levels, each level being characterized by a specific set of lights, sounds and/or vibrations emanating from the game. Once the game is started, a first sequence of lights, sounds and/or vibrations begins to indicate that the game is in the first level. If the balancing tube remains balanced, the game progresses to a second level, indicated by a new set of lights sounds and/or vibrations. As long as the tube remains balanced, the game continues advancing through various game levels until a final level is reached. Throughout the levels, various lights illuminate on the balancing tube, sounds are emitted, and the vibrator may activate or deactivate.

Figure 1A:
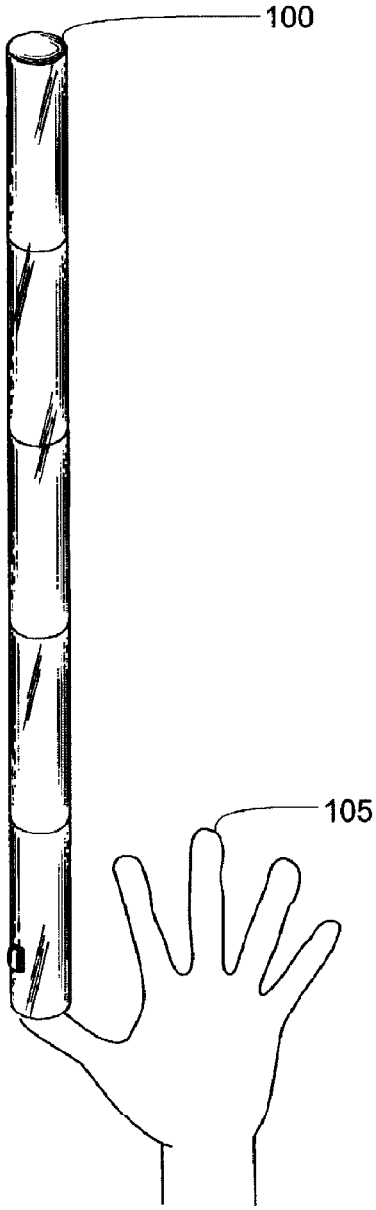
FIGS. 1A and 1B illustrate exemplary usage of a balancing tube apparatus, in accordance with the invention.
Figure 1B:
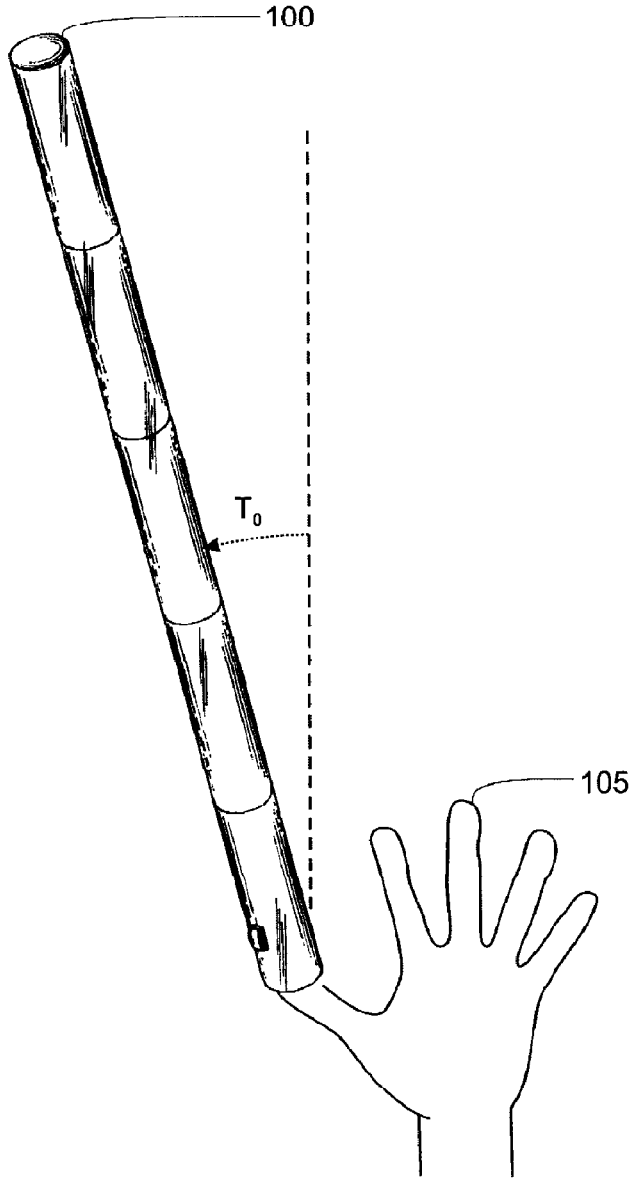

FIGS. 1A and 1B depict the balancing tube game of the present invention in typical usage. FIG. 1A shows balancing tube game 100 balanced in a vertical orientation on the thumb of a player's hand 105. The ornamental design for a preferred embodiment of the balancing tube game 100 is the subject of design patent D485,869. As shown in FIG. 1A, the balancing tube game is substantially vertically oriented. In this orientation, the balancing tube is "balanced", and game play proceeds. FIG. 1B shows the balancing tube game 100 deflected (tilted) from vertical orientation by a critical angle $T_0$. As will be described in greater detail hereinbelow, the balancing tube game detects tilt angles of $T_0$ or greater and ends game play. In an exemplary embodiment, the value of $T_0$ is 45 degrees.

In FIGS. 1A and 1B, the balancing tube game 100 is shown balanced on the thumb of a player's hand 105. This is merely an exemplary representation of game play and is not intended to be limiting in any way. The balancing tube game is intended to be balanced in any of a wide variety of ways.

Figure 2:
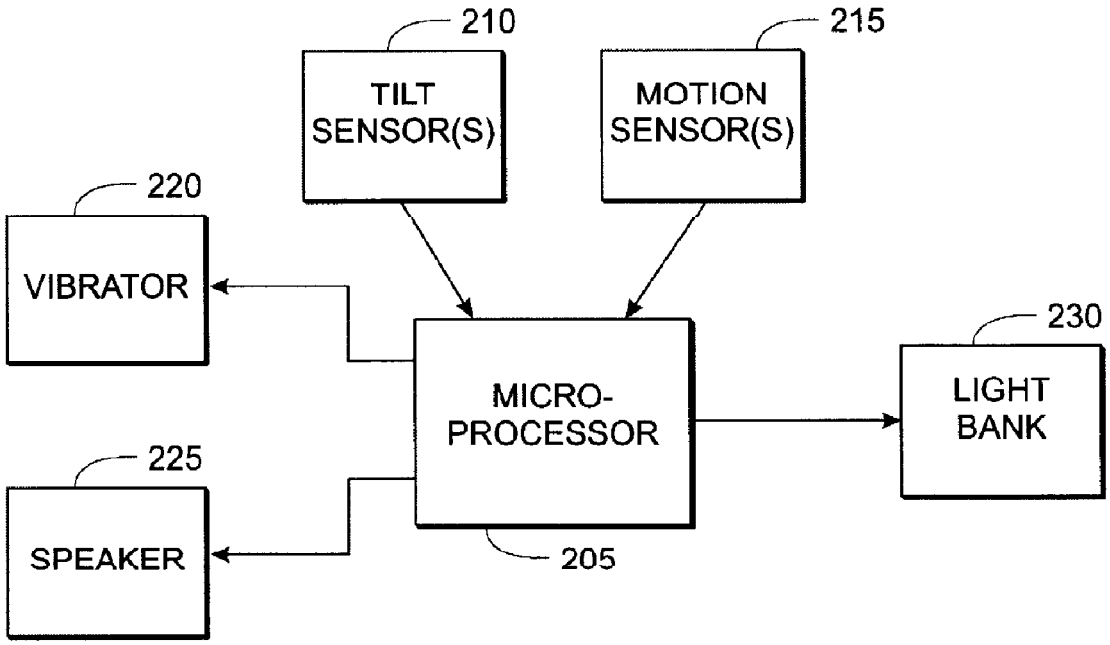
FIG. 2 is a block diagram of the balancing tube apparatus, in accordance with the invention.

FIG. 2 is a block diagram of the balancing tube game apparatus 200, in accordance with the invention. All of the electronic components represented in the block diagram 200 are housed inside the balancing tube game apparatus 100. A microprocessor 205 controls overall operation of the balancing tube. In an exemplary embodiment, microprocessor 205 is a PIC16F628 microcontroller from MICROCHIP TECHNOLOGY INC., Chandler Ariz., USA. Microprocessor 205 receives an indication from tilt sensor(s) 210 when the tilt angle of balancing tube with respect to vertical exceeds a predetermined critical angle. Optionally, motion sensor(s) 215 detect the player's movements in attempting to keep the balancing tube vertical, indicating said motion to the microprocessor 205. Microprocessor 205 provides feedback to the user via aural, visual, and tactile methods. A speaker 225 controlled by the microprocessor 205 provides audible feedback. A vibrator 220 controlled by the microprocessor 205 provides tactile feedback. A light bank 230 controlled by the microprocessor 205 provides visual feedback. In combination, the pattern of lights, sounds and vibrations presented to the user indicates the game level. Additionally, changing feedback from the speaker 225, vibrator 220 and lights 230 can act as a distraction to make the game more challenging.

Light bank 230 comprises a plurality of lights. In a preferred embodiment, the lights are light emitting diodes (LEDs), including red, amber, yellow, and green lights. The lights are preferably arranged such that one color is mounted within one segment of the balancing tube. The balancing tube is preferably made of a translucent material such as plastic, allowing the LEDs to be mounted within the balancing tube. The balancing tube also houses a power source (not shown). In a preferred embodiment, the power source consists of three AA batteries in series, providing a 4.5 volt power source.

Figure 3:
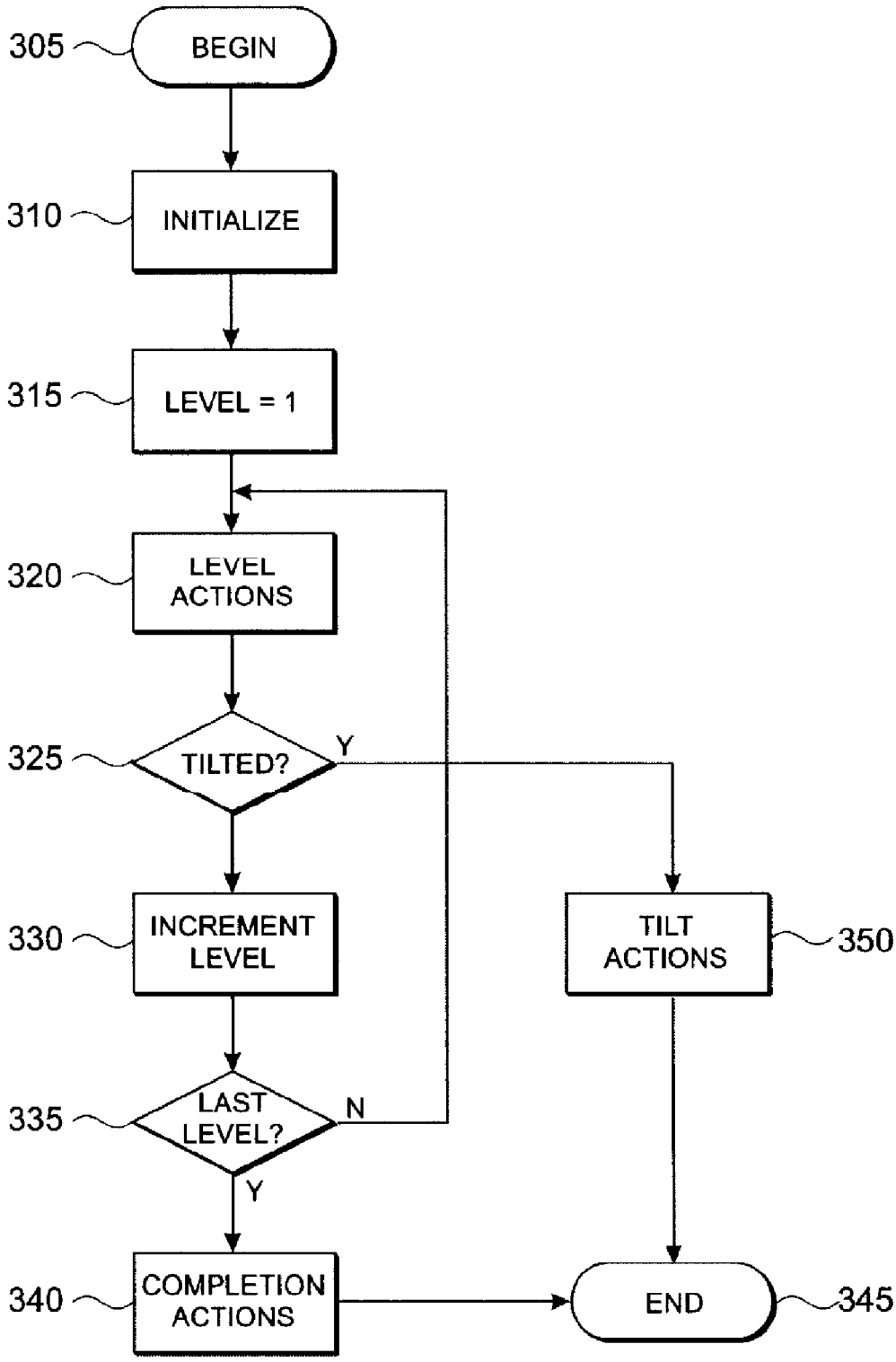
FIG. 3 is a flowchart showing a first exemplary game sequence executed by the balancing tube apparatus of the present invention.

FIG. 3 is a flowchart 300 showing a first exemplary game sequence executed by the balancing tube apparatus of the present invention. The game starts at terminal 305 ("BEGIN"), proceeding immediately to an initialization sequence 310. In an exemplary embodiment, timing initialization sequence 310 consists of emitting a first short beep from speaker 225 (FIG. 2), flashing the green LED of the light bank 230 (FIG. 2), and emitting a second beep from speaker 225. This alerts the user that the game is about to start.

In an exemplary embodiment, there are nine (9) levels of game play. In step 315, the game play level is set to one (1). In a next step 320, specific actions for the current game play level are performed. These actions include combinations of flashing lights in light bank 230, activating vibrator 220, and emitting tones from speaker 225. In one exemplary embodiment, the game play level is indicated by flashing one or more LEDs a number of times corresponding to the game play level number. It is also possible to emit a different sound for each completed level, or momentarily activate the vibrator a number of times corresponding to each completed level, or a combination of methods may be used. There are many possibilities.

Each level lasts a predetermined amount of time. In an exemplary embodiment, the time interval is eight seconds. However, it is possible to have different time intervals corresponding to different skill levels of the game. During the time interval, tilt sensor 210 (FIG. 2) is periodically checked in step 325. If the tilt level from vertical exceeds a predetermined critical angle, a tilt action sequence is executed in step 350, and game play ends at terminal 345. It is also possible to use an interrupt driven tilt sensor, thereby avoiding the need for polling the tilt sensor. In an exemplary embodiment, tilt action sequence 350 comprises generating a tone via speaker 225, and flashing the red LEDs. If the user maintains the balancing tube in a vertical orientation for the predetermined time interval, then the game play level is incremented in step 330, and the process repeats for each remaining level. Different levels can have different actions at step 320. For example, at an intermediate level, the vibrator can be activated to make it more difficult to maintain balance.

In step 335, a check is made to see if the final level has been successfully completed. If so, the successful completion actions are performed at step 340. These actions may include playing a melody or song via speaker 225, and flashing a pattern with the various LEDs comprising light bank 230. The vibrator 220 can also be used. After performing the game completion actions, the game ends at terminal 345.

Figure 4:
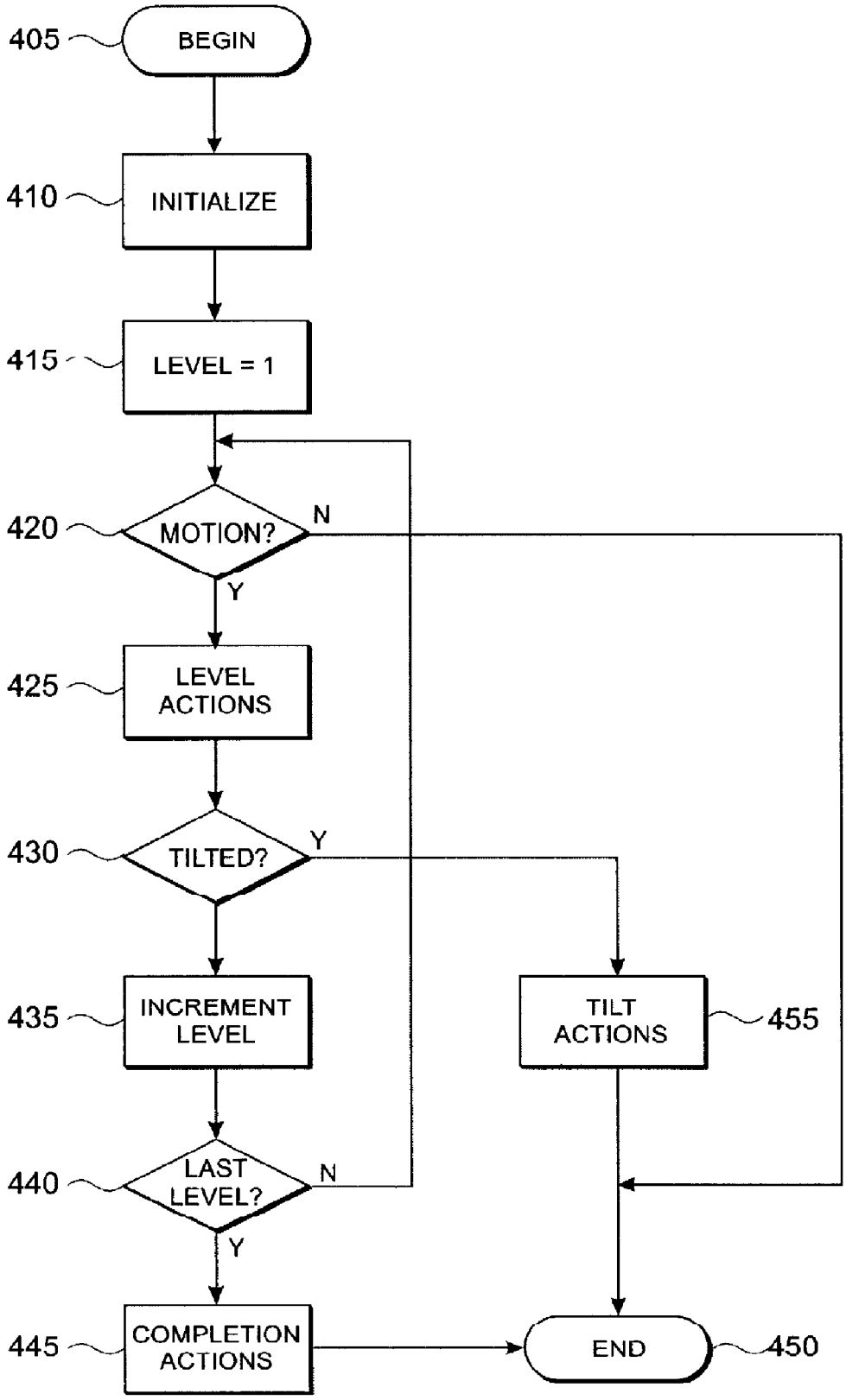
FIG. 4 is a flowchart showing a second exemplary game sequence executed by the balancing tube apparatus, in accordance with the invention.

FIG. 4 is a flowchart 400 showing a second exemplary game sequence executed by the balancing tube apparatus of the present invention. The flowchart 400 is similar to the flowchart 300, except that in addition to monitoring the tilt sensor 210, the motion sensor 215 is monitored as well. The motion sensor 215 detects the user's actions in trying to balance the tube. Without the motion sensor 215, it would be possible to "fool" the balance tube game by setting it in a stand or leaning it against a wall and the game would proceed all the way to the highest game level. With the motion sensor 215, the microprocessor 205 can confirm that a player is actually attempting to balance the tube by manipulating it. If the microprocessor 205 determines that there has been no motion for a period of time, it can discontinue the game, or power the game down into a low power mode. Upon detecting motion again, the microprocessor can once again re-start game play. Like the tilt sensor 210, an interrupt-driven scheme can be used to monitor the motion sensor 215, eliminating the need to repeatedly poll the sensor as part of the game loop.

Like the flowchart 300, the flowchart 400 starts the game at terminal 405 ("BEGIN"), proceeding immediately to an initialization sequence 410 (compare 310). In a next step 415, the game play level is set to one (1). In a next step 420, the motion sensor is checked to confirm that the balance tube is being manipulated. If it is, game play proceeds to a next step 425 wherein specific actions for the current game play level are performed.

Each level lasts a predetermined amount of time. During the time period associated with a game level, tilt sensor 210 (FIG. 2) is periodically checked in step 430. If the tilt level from vertical exceeds a predetermined critical angle, a tilt action sequence is executed in step 455, and game play ends at terminal 450. As stated hereinabove with respect to FIG. 3, it is possible to use an interrupt driven tilt sensor, eliminating the need to poll the tilt sensor 210 as part of the game loop.

In step 440, a check is made to see if the final level has been successfully completed. If so, the successful completion actions are performed at step 445, and the game ends at terminal 345.

Figure 5:
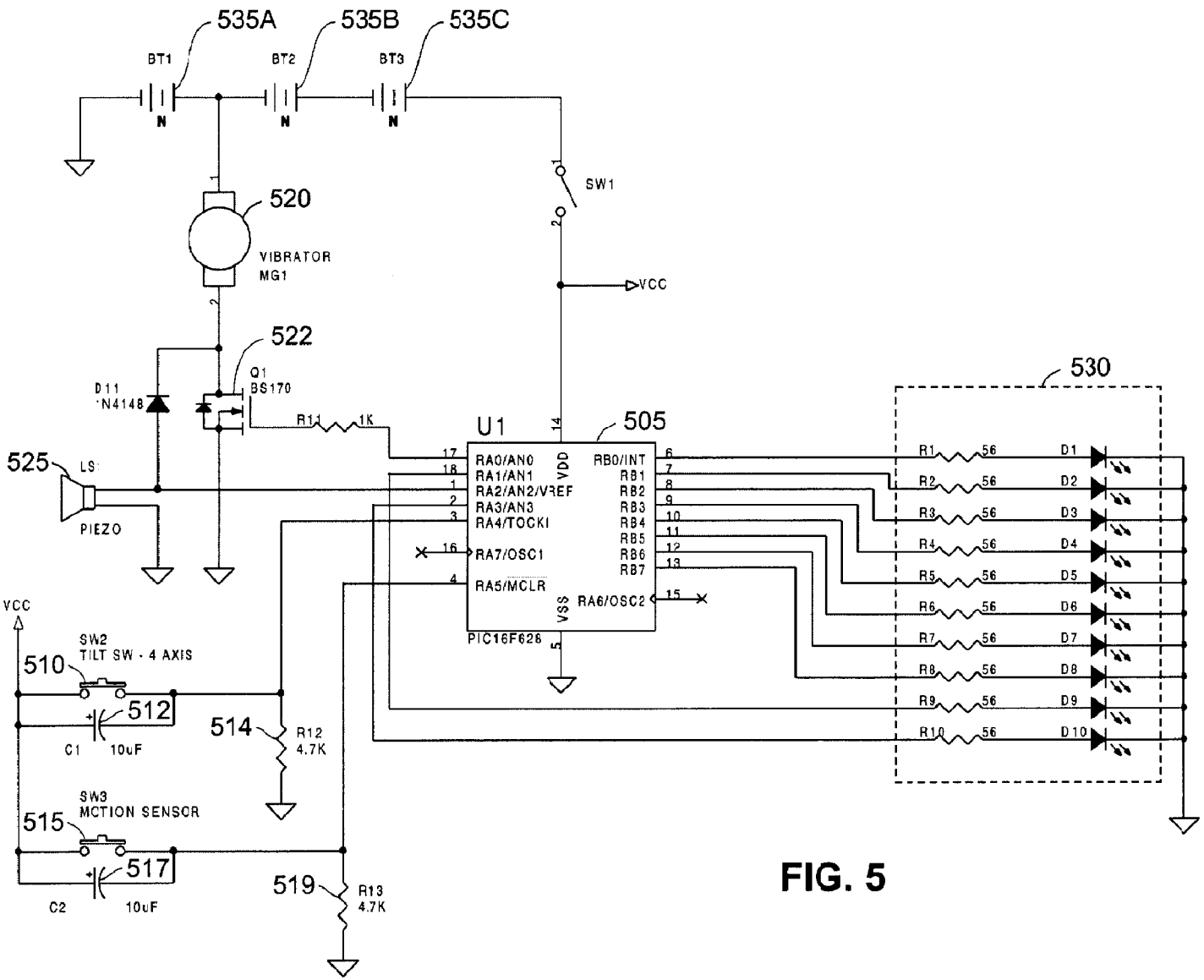
FIG. 5 is a schematic diagram of a preferred embodiment of a balancing tube apparatus, in accordance with the invention.

FIG. 5 is a schematic diagram 500 of a preferred embodiment of the present invention. A single-chip microcontroller 505 acts as the "brain" of the balance tube game and controls all of its behavior.

A tilt sensor function (see 210, FIG. 2) is provided by a 4-axis tilt switch 510. The tilt switch 510 is mounted inside the balance tube game and closes whenever the balance tube falls beyond a predetermined critical angle from vertical. In one exemplary embodiment, the critical angle is 45 degrees. A capacitor 512 and a resistor 514 filter the output of the switch, simultaneously "debouncing" it and ensuring that the switch will initially appear to be closed at power-up until the capacitor 512 charges. The tilt sensor switch 510 is connected to an input of the microcontroller 505.

A motion sensor function (see 215, FIG. 2) is provided by a motion sensor switch 510 (essentially an accelerometer "switch" that closes whenever acceleration exceeds a predetermined threshold level, e.g., 0.25 g). Those of ordinary skill in the art will immediately understand and appreciate that a suitable motion sensor switch can be readily made from one or more piezoelectric "vane" type accelerometers driving a comparator. The motion sensor switch 515 is mounted inside the balance tube game and closes whenever motion above a predetermined threshold level is detected. A capacitor 517 and a resistor 519 filter the output of the motion sensor. The motion sensor switch 515 is connected to an input of the microcontroller 505. The motion sensor switch 515 is an optional feature and may be left out if not used.

As shown in the Figure, the microcontroller 505 receives power from a series combination of three batteries, 535A (BT1), 535B (BT2) and 535C (BT3). A power switch SW1 provides main power to the circuit, including the microcontroller 505. Battery 535A (BT1) provides power for the vibrator motor 520 (compare 220, FIG. 2). The vibrator is a small DC motor with an eccentric weight attached to its shaft such that when the motor turns it vibrates. This is the same technique used to provide the vibrate function in cell phones. An output from the microcontroller 505 drives a transistor 522 that powers the motor. The microcontroller produces sound by means of a speaker 525 connected to one of its outputs.

A bank of LEDs 530 (compare light bank 230, FIG. 2) is connected to a set of outputs of the microcontroller 505 such that by activating selected outputs, the microcontroller 505 can controller which LEDs are lit.

Appendix A is a software listing of BASIC language code for the microcontroller (205, 505), corresponding to the flowchart 300 of FIG. 3.

As the above description shows, the present invention provides a game, and apparatus for playing the game. The balancing tube apparatus is easily and economically manufactured from common components. The game is fun, safe, economical, and also helps develop motor skills.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described inventive components the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A balancing tube game apparatus comprising:

an elongated tube, said tube enclosing an electronic circuit, said electronic circuit further comprising:

a microcontroller;

a tilt sensor connected to an input of said microcontroller;

a speaker controllable by said microcontroller to produce audible sounds;

a vibrator controllable by said microcontroller to produce tactile vibrations;

a light bank controllable by said microcontroller to produce a plurality of light patterns.

2. A balancing tube game according to claim 1, wherein said light bank comprises a plurality of LEDs, said LEDs controllable by said microcontroller and disposed within said elongated tube such that when illuminated, said LEDs are visible through said elongated tube.

3. A balancing tube game according to claim 2, wherein said elongated tube is made of a translucent material.

4. A balancing tube game according to claim 1, wherein said vibrator is motor-driven eccentric weight controllable by said microcontroller.

5. A balancing tube game according to claim 1, wherein said microcontroller monitors said tilt sensor during a plurality of predetermined time intervals, providing feedback to a user via said light bank, said speaker and said vibrator.

6. A balancing tube game according to claim 5, wherein multiple game levels of predetermined duration are indicated by associated patterns of lights, sound and vibration from said light bank, speaker and vibrator, respectively.

7. A balancing tube game according to claim 6, wherein upon successful completion of a final game level, said microcontroller produces a game completion sequence comprising a specific sequence of lights, sounds and vibration.

8. A balancing tube game according to claim 6, wherein upon detection of a tilt condition whereby said elongated tube has fallen beyond a predetermined critical angle with the vertical, said microcontroller produces a tilt sequence comprising a specific sequence of lights, sounds and vibration.

9. A balancing tube game apparatus comprising:

an elongated tube, said tube enclosing an electronic circuit, said electronic circuit further comprising:

a microcontroller;

a tilt sensor connected to an input of said microcontroller;

a motion sensor connected to an input of said microcontroller;

a speaker controllable by said microcontroller to produce audible sounds;

a vibrator controllable by said microcontroller to produce tactile vibrations;

a light bank controllable by said microcontroller to produce a plurality of light patterns.

10. A balancing tube game according to claim 9, wherein said light bank comprises a plurality of LEDs, said LEDs controllable by said microcontroller and disposed within said elongated tube such that when illuminated, said LEDs are visible through said elongated tube.

11. A balancing tube game according to claim 9, wherein said vibrator is motor-driven eccentric weight controllable by said microcontroller.

12. A balancing tube game according to claim 9, wherein:

said microcontroller monitors said tilt sensor and motion sensor during a plurality of predetermined time intervals, providing feedback to a user via said light bank, said speaker and said vibrator.

13. A balancing tube game according to claim 12, wherein:

said microcontroller discontinues game play if no motion is sensed during a predetermined time period.

14. A balancing tube game according to claim 13, wherein multiple game levels of predetermined duration are indicated by associated patterns of lights, sound and vibration from said light bank, speaker and vibrator, respectively.

15. A balancing tube game according to claim 14, wherein upon detection of a tilt condition whereby said elongated tube has fallen beyond a predetermined critical angle with the vertical, said microcontroller produces a tilt sequence comprising a specific sequence of lights, sounds and vibration.

16. A method of playing a game, comprising the steps of:

providing an elongated, cylindrical balancing tube game apparatus, said game apparatus being adapted to monitor a tilt sensor and to provide visual, audible and tactile indications to a user thereof;

balancing said game apparatus on a body part for a predetermined amount of time on a plurality of game levels; and receiving a game level indication upon completing each level if said game apparatus is maintained at angle less than a predetermined critical angle off-vertical;

receiving an unsuccessful completion indication if said game apparatus tilts beyond a predetermined critical angle off-vertical during any of the levels;

receiving a successful game completion indication upon successful completion of a final game level.

17. A method of playing a game according to claim 16, wherein said balancing tube game apparatus is further adapted to detect motion associated with manipulation of the game apparatus, said method further comprising the step of:

receiving a game end indication if no motion is detected during any game level.

* * * * *